US008870018B2

(12) United States Patent
Cook et al.

(10) Patent No.: US 8,870,018 B2
(45) Date of Patent: Oct. 28, 2014

(54) SLEEVE FOR A CONTAINER

(75) Inventors: Matthew R. Cook, Hinsdale, IL (US); Thomas Fu, Naperville, IL (US); Kurt M. Wolf, Evanston, IL (US); Lauren Mikos, Chicago, IL (US); Barry L. Silverstein, Northbrook, IL (US)

(73) Assignee: LBP Manufacturing, Inc., Cicero, IL (US)

( * ) Notice: Subject to any disclaimer, the term of this patent is extended or adjusted under 35 U.S.C. 154(b) by 911 days.

(21) Appl. No.: 12/710,176

(22) Filed: Feb. 22, 2010

(65) Prior Publication Data

US 2010/0219195 A1 Sep. 2, 2010

Related U.S. Application Data

(60) Provisional application No. 61/156,064, filed on Feb. 27, 2009.

(51) Int. Cl.

| | |
|---|---|
| ***B65D 65/00*** | (2006.01) |
| ***B65D 81/38*** | (2006.01) |
| ***A47G 23/02*** | (2006.01) |

(52) U.S. Cl.

CPC ..... *B65D 81/3876* (2013.01); *B65D 2313/00* (2013.01); *A47G 23/0241* (2013.01); *A47G 23/0216* (2013.01); *A47G 23/0266* (2013.01)

USPC ..... 220/739; 220/737; 229/87.01

(58) Field of Classification Search

CPC ..... A47G 23/0216; A47G 23/0208; A47G 23/0241

USPC ..... 220/738, 739; D9/444; 156/69; 222/461; 141/337

See application file for complete search history.

(56) References Cited

U.S. PATENT DOCUMENTS

| | | | | |
|---|---|---|---|---|
| 228,002 | A | | 5/1880 | Swope |
| 228,022 | A | * | 5/1880 | Swope ..... 229/89 |
| 2,414,274 | A | * | 1/1947 | Sass et al. ..... 106/146.4 |
| 5,205,473 | A | | 4/1993 | Coffin, Sr. |
| 5,222,656 | A | | 6/1993 | Carlson |
| 5,454,484 | A | | 10/1995 | Chelossi |
| D383,947 | S | | 9/1997 | Schaefer |
| 5,667,135 | A | | 9/1997 | Schaefer |
| 5,746,372 | A | | 5/1998 | Spence |
| 5,765,716 | A | | 6/1998 | Cai et al. |

(Continued)

FOREIGN PATENT DOCUMENTS

WO WO 2004/103854 12/2004

OTHER PUBLICATIONS

Bangladesh Examination Report from corresponding Bangladesh Patent Application No. 45/2010/3924, 2pp., dated Oct. 25, 2010.

(Continued)

*Primary Examiner* — Fenn Mathew
*Assistant Examiner* — Kevin Castillo
(74) *Attorney, Agent, or Firm* — Hasse & Nesbitt LLC; Daniel F. Nesbitt

(57) ABSTRACT

An adjustable sleeve is disclosed that employs a pivot region which allows rotation of the first end of the sleeve relative to the second end of the sleeve. Rotation about the pivot region allows the sleeve size to adapt to many different sizes and tapers of containers. Rotation results in increasing a diameter of the top of the sleeve and decreasing a diameter of the bottom of the sleeve, and vice versa.

17 Claims, 7 Drawing Sheets

(56) References Cited

U.S. PATENT DOCUMENTS

| | | | | |
|---|---|---|---|---|
| 5,826,786 | A * | 10/1998 | Dickert | 229/403 |
| 5,857,615 | A | 1/1999 | Rose | |
| 6,152,363 | A | 11/2000 | Rule, Jr. | |
| 6,364,151 | B1 | 4/2002 | Gale | |
| 6,655,543 | B2 | 12/2003 | Beuke | |
| 6,986,438 | B2 | 1/2006 | Leung | |
| 7,000,801 | B2 | 2/2006 | Rodriguez | |
| 7,111,753 | B2 | 9/2006 | Scheetz, II et al. | |
| 2002/0179617 | A1 * | 12/2002 | Barthlow et al. | 220/739 |
| 2003/0146228 | A1 | 8/2003 | Davis et al. | |
| 2005/0056654 | A1 * | 3/2005 | Leung | 220/737 |
| 2005/0082302 | A1 | 4/2005 | Fischer | |
| 2005/0230405 | A1 | 10/2005 | Dix | |
| 2006/0186129 | A1 | 8/2006 | Allnutt et al. | |
| 2007/0212501 | A1 * | 9/2007 | Wolfe et al. | 428/34.1 |
| 2007/0257049 | A1 | 11/2007 | Tolan | |
| 2007/0278687 | A1 * | 12/2007 | Lin | 257/759 |
| 2008/0041864 | A1 | 2/2008 | Wong | |
| 2008/0078824 | A1 | 4/2008 | Spriegel et al. | |

OTHER PUBLICATIONS

International Search Report from corresponding International Application No. PCT/US2010/025010, dated Jun. 7, 2010.

International Preliminary Report on Patentability from corresponding International Application No. PCT/US2010/025010, dated Sep. 9, 2011.

Canadian Examiner's Report from corresponding Canadian Patent Application No. 2,745,906, 2pgs., dated Nov. 2, 2012.

* cited by examiner

SLEEVE FOR A CONTAINER

RELATED APPLICATIONS

The present patent document claims the benefit of the filing date under 35 U.S.C. §119(e) of Provisional U.S. Patent Application Ser. No. 61/156,064, filed Feb. 27, 2009, which is hereby incorporated by reference.

BACKGROUND

Hot and cold beverages (e.g., coffee, tea, soft drinks, and the like) are often sold in disposable drink cups for example, paper, plastic, and foam drinking cups. Sleeves are sometimes used in conjunction with the cup to convey information such as advertising, branding, or promotions or to help isolate a hand of the user from a temperature of the contents of the cup. A one-size sleeve, however, may not work well with different sized cups.

BRIEF SUMMARY

An adjustable sleeve for a container is disclosed. The sleeve includes a body having a top edge defining an opening, a bottom edge defining an opening, a first end and a second end. The first end and the second end are joined by a closure device to form a conical configuration of the body. The closure device permits inverse rotation of the first end relative to the second end which translates into an inverse diameter change in the opening defined by the top edge and the opening defined by the bottom edge. The rotation may permit the sleeve to adjust to the size and taper of many different cups and other containers.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

Containers such as cups and food containers are used widely in offices, restaurants, cafes, convenience stores, and other establishments. The containers may come in a wide variety of sizes, from, for example, approximately 2 oz to approximately 32 oz and larger.

An adjustable sleeve for use with a container is disclosed. The adjustability of the sleeve may allow one sleeve to conform to containers of varying sizes and tapers. Using an adjustable sleeve to convey information and/or provide thermal insulation may, among other attributes, have manufacturing efficiencies, may reduce waste, and may facilitate quick promotional strategy changes.

Figure 1:
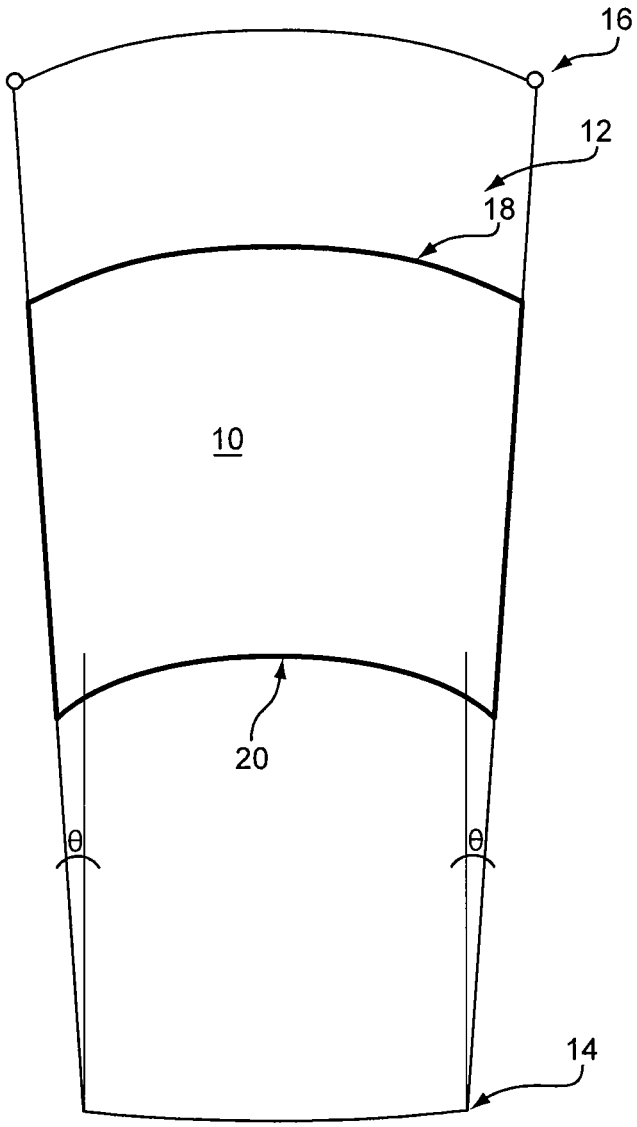
FIG. 1 is a front view of a sleeve assembled with a container.

In FIG. 1, a sleeve 10 may be positioned with a container 12. The sleeve 10 may be removable from the container 12, fixedly attached to the container 12 and/or removably affixed to the container 12. The container 12 may include a base 14 end and a rim 16 end. The container 12 may be manufactured of plastic, foam, paper, or any other material, and may be adapted to hold hot or cold food or beverages.

The base 14 of the container 12 may include a diameter that is smaller than the diameter of the rim 16 such that the side walls taper in from the open top to the closed base of the container 12. The taper may be designated by the taper angle $\Theta$ of a wall of the container 12 from vertical. The taper angle $\Theta$ of a container 12 may change as a function of the size of the container 12, for example, the taper angle $\Theta$ may be in the range of $\Theta=0°$ to $\Theta=40°$ or greater. The sleeve 10 may also be used with containers 12 that contain no taper or which have a negative taper such that the base 14 has a diameter larger than the rim 16.

The sleeve 10 may be combined with the container 12 such that the sleeve 10 encircles the circumference of the container 12. The sleeve may define a first edge 18, such as a top edge and a second edge 20, such as a bottom edge. The first edge 18 and the second edge 20 may be arched. The sleeve 10 may be affixed to the container 12, such as by friction or by adhesives such as hot-melt, fugitive or non-fugitive glue. The sleeve 10 may be manufactured of, for example, paperboard, cardboard, fluted board, plastic, foam, cellulosic fiber, white virgin paper, brown recycled paper, or other materials and may be recyclable or compostable. Additionally, the sleeve 10 may be, for example, one or more layers, may have corrugation, fluting, air channels, air pockets, embossing, debossing, scoring, notches, slits, or etc. Scoring, notching, or slits may lend further adjustability to the shape of the sleeve.

The sleeve 10 may have a surface that faces the cup 12 and a surface that faces away from the cup 12. Either surface of the sleeve may include, for example, graphics, information, advertising, thermochromic features, and/or photochromic features. For example, the sleeve may have thermochromic features, such as graphics which may change colors due to a change in temperature. As another example, the sleeve may have photochromic features that undergo a change when they react to light. Such features may be useful for adapting a container to the function of, for example, providing the temperature of the contained material. Alternatively or additionally, a surface may be coated with a barrier material, for example but not limited to, wax, foam, glues, chemicals, dyes, or any other material that, for example, provides a protective surface.

Figure 2:
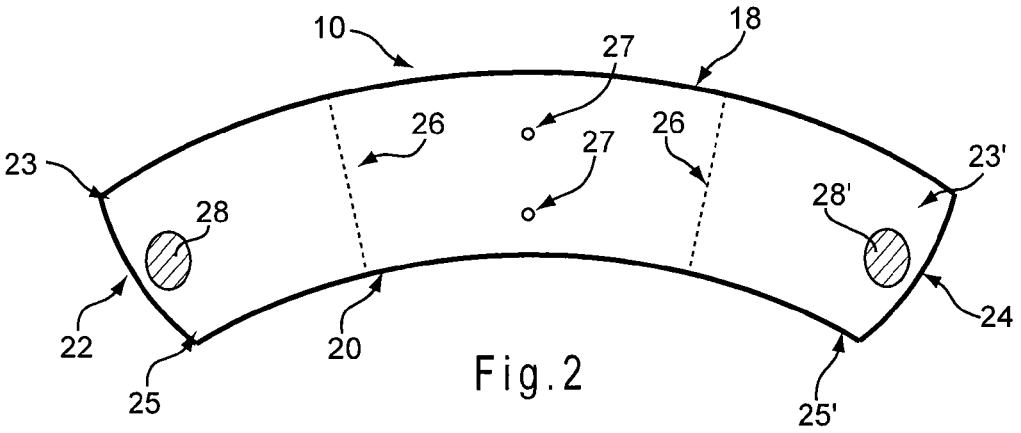
FIG. 2 is a view of a sleeve blank.

FIG. 2 illustrates a blank of an exemplary sleeve 10. The blank of the sleeve 10 may include a first edge 18 and a second edge 20 of the sleeve 10, which may be the top and bottom of the blank, or vice versa. The blank of the sleeve 10 may also include a first end 22 and a second end 24. The first end 22 and second end 24 of the sleeve blank may include a top corner 23, 23' respectively, where the ends 22, 24 meet with the first edge 18 of the sleeve 10. The first end 22 and second end 24 of the blank of the sleeve 10 may include a bottom corner 25, 25', respectively where the ends 22, 24 meet with the second edge 20 of the blank of the sleeve 10.

The first end 22 of the blank of the sleeve 10 may include a closure area 28, which may be approximately centered between the top corner 23 and the bottom corner 25. Alternatively or additionally, the second end 24 of the sleeve 10 may include a closure area 28', which may be approximately centered between the top corner 23' and the bottom corner 25'. The closure areas 28, 28' may be of any shape, for example but not limited to, circular, diamond, rectangular, or irregular.

Figure 3:
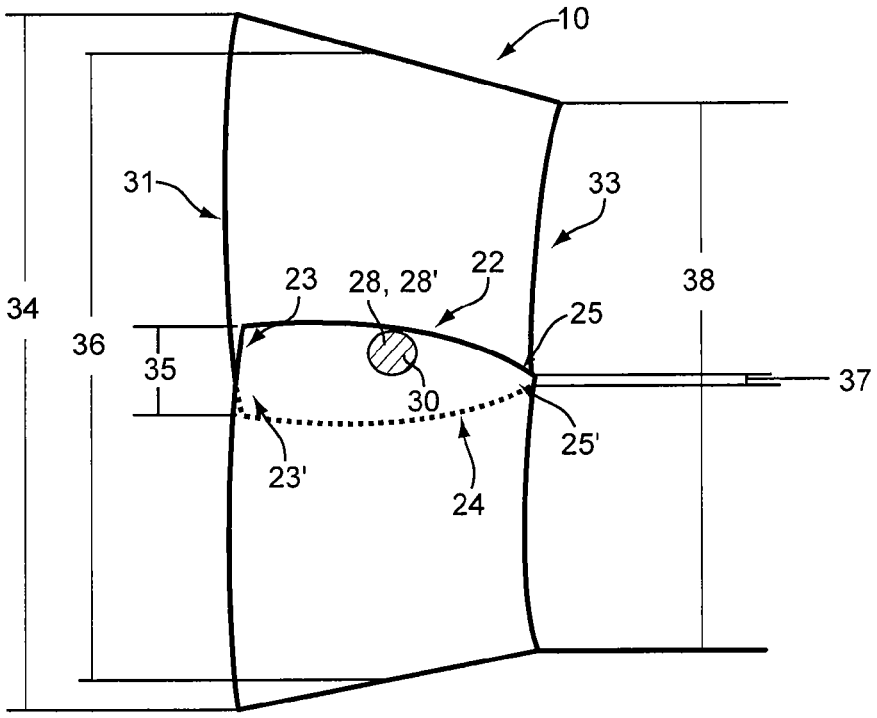
FIG. 3 is a view of a sleeve in a neutral state taper.

Referring also to FIG. 3, the sleeve 10 may be formed by joining the ends 22, 24 of the blank of the sleeve 10 together to form a continuous or interrupted ring. The ends 22, 24 of the blank of the sleeve 10 may be joined at a closure area, 28, 28' by, for example, adhesive, a bolt/flange fastener 21, or any other device allowing flexibility, such as rotation. For example, the ends 22, 24 of the blank of the sleeve 10 may be joined at a closure area 28, 28' by an adhesive. The adhesive may be a fugitive glue, for example, a flexible or yieldable fugitive glue and/or a flexible or yieldable hot melt adhesive (e.g., pressure sensitive hot melt adhesives). The adhesive may be applied to a closure area 28, 28' and may create a pivot region 30. The adhesive may secure the ends 22, 24 while still permitting flexibility at the pivot region FIG. 3, 30 where the ends 22, 24 are secured.

Figure 4:
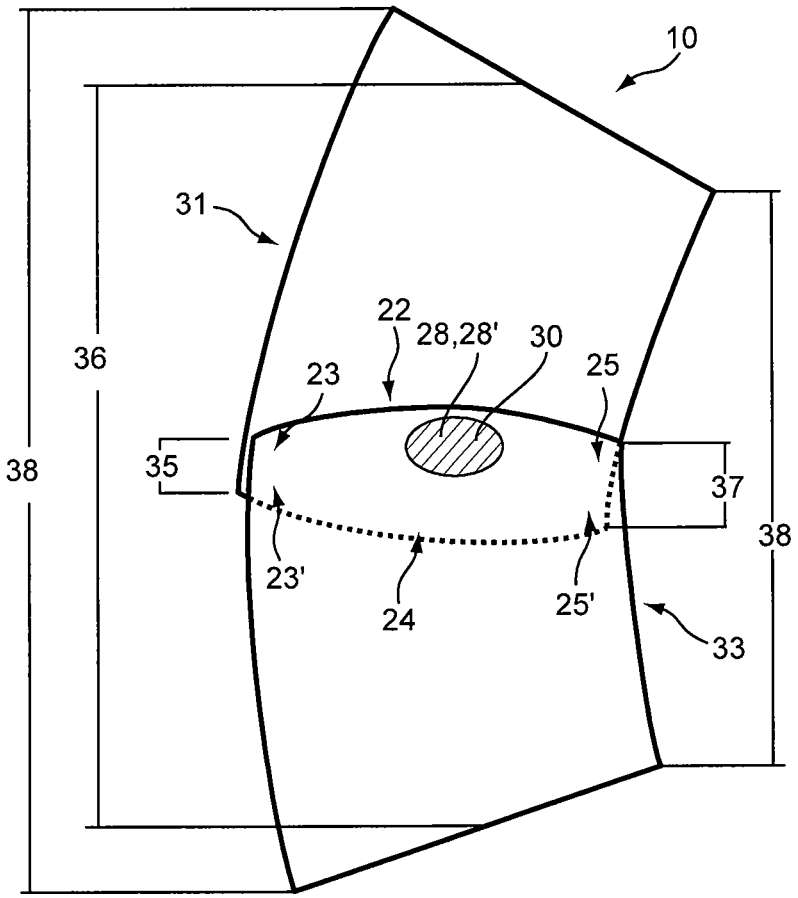
FIG. 4 is a view of a sleeve in an obtuse taper.
Figure 5:
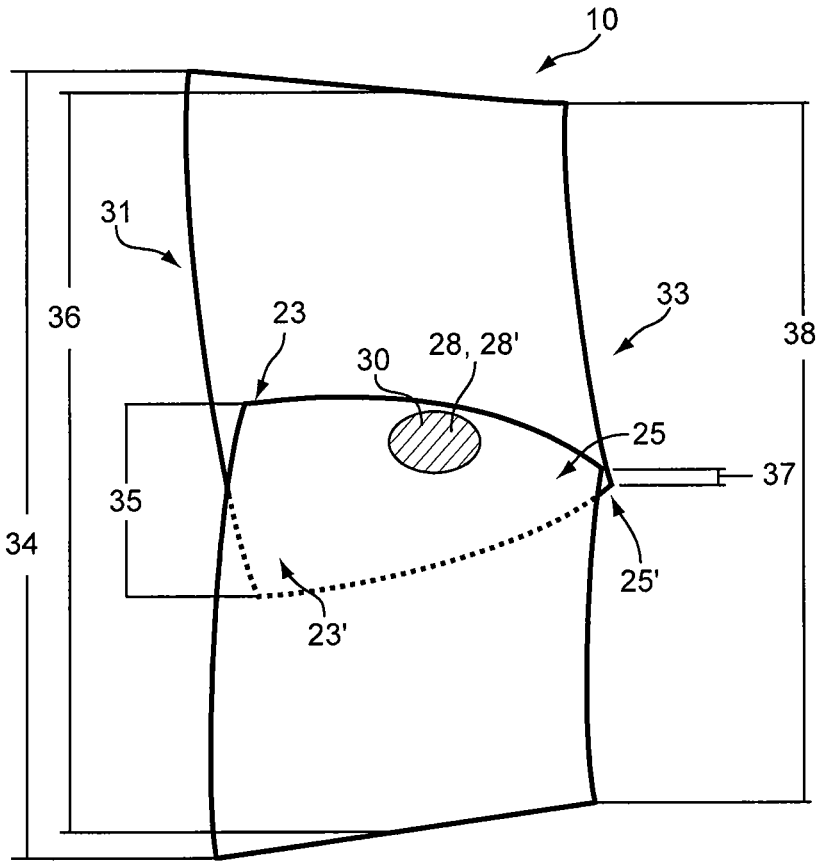
FIG. 5 is a view of a sleeve with an acute taper.

The blank of the sleeve 10 may also include perforations 26 (FIG. 2), such that, when removed from a container 12, the sleeve 10 can be collapsed into a flat plane (FIGS. 3-5). Collapsing into a flat plane may permit the sleeves to be efficiently packed in ready-to-use form. The flat-plane form of the sleeve 10 may also provide efficiencies for storing, for example, on counter tops, in storage containers, in boxes, on shelves, and etc. The sleeve 10 may be converted from collapsed form to uncollapsed form by, for example, pushing inward on the fold lines created by the perforations 26 (FIG. 2).

Adhesive regions 27 (FIG. 2) may be applied also to other locations of the sleeve such as at the vertical midline of the inside surface of the sleeve (e.g., the surface facing the container 12). The adhesive regions 27 (FIG. 2) may secure the sleeve 10 to a container 12. The adhesive region 27 (FIG. 2) may be a fugitive glue, or heat activatable glue, which may flex with the sleeve 10, or it may be a hot melt or any other adhesive.

FIG. 3 illustrates the back of a sleeve 10 in a neutral (e.g., unflexed) and collapsed configuration. The neutral configuration of a sleeve may differ depending on an implementation. The sleeve 10 may be been formed by joining the ends 22, 24 of the sleeve 10. The ends 22 and 24 may be joined at a closure area 28, which may create a pivot region 30. The pivot region 30 may permit the corners 23, 23', 25, 25' to rotate relative to each other. For example, rotation at the pivot region 30 may increase the overlap distance 35 between the corners 23 and 23' while decreasing the overlap distance 37 between the corners 25 and 25'.

The sleeve 10 may have an opening for receiving a container 12 at the first end 31 and at the second end 33 of the sleeve 10. The sleeve 10, (e.g., when applied to a container) may have a diameter. For example, the sleeve 10 may have a diameter 34 which may represent the diameter 29 of the first end 31 of the sleeve 10, a diameter 36 which may represent the diameter at or near the pivot region 30, and a diameter 38 which may represent the diameter at the second end 33 of the sleeve 10.

FIG. 4 illustrates the sleeve 10 that has been rotated to fit a taper angle Θ (FIG. 1) greater than neutral. The sleeve 10 may adapt the increased taper angle Θ (FIG. 1) of a container 12 by, for example, flexing outward. For example, as a container 12 is inserted through a top 31 of the sleeve 10, the taper of the sleeve 10 may increase by rotation at the pivot region 30. Rotation of the ends 22, 24 of the sleeve 10 about the pivot region 30 may decrease the overlap distance 35 between corners 23 and 23', which may increase the diameter 34. This rotation may concurrently increase the overlap distance 37 between corners 25 and 25' which may decrease the diameter 38. The diameter 36 at or around the pivot region 30 may remain relatively constant throughout the rotation or may increase or decrease slightly (e.g., to a smaller degree than the change in 34 and 38). As the sleeve 10 flexes outward, the pitch of the first edge 18 (FIG. 1) and second edge 20 (FIG. 1) may increase or decrease.

FIG. 5 illustrates a sleeve 10 that has been rotated to fit a taper angle Θ (FIG. 1) less than neutral. The sleeve 10 may adapt the increased taper angle Θ (FIG. 1) of a container 12 by, for example, flexing inward. For example, as a container 12 is inserted through a top 31 of the sleeve 10, the taper of the sleeve 10 may decrease by rotation of the sleeve about the pivot region 30. Rotation of the ends 22, 24 of the sleeve 10 about the pivot region 30 may increase the overlap distance 35 between corners 23 and 23', which may decrease the diameter 34. This rotation may concurrently decrease the overlap distance 37 between corners 25 and 25' which may increase the diameter 38. The diameter 36 of the pivot region 30 may remain relatively constant throughout the rotation or may increase or decrease slightly (e.g., to a smaller degree than the change in 34 and 38). The diameter 36 may not be at the same location during all conformations. However, regardless of the increase or decrease in diameters 34 and 38, a diameter 36 will remain relatively constant. As the sleeve 10 flexes inward, the pitch of the first edge 18 (FIG. 1) and the second edge 20 (FIG. 1) may increase or decrease.

Figure 6:
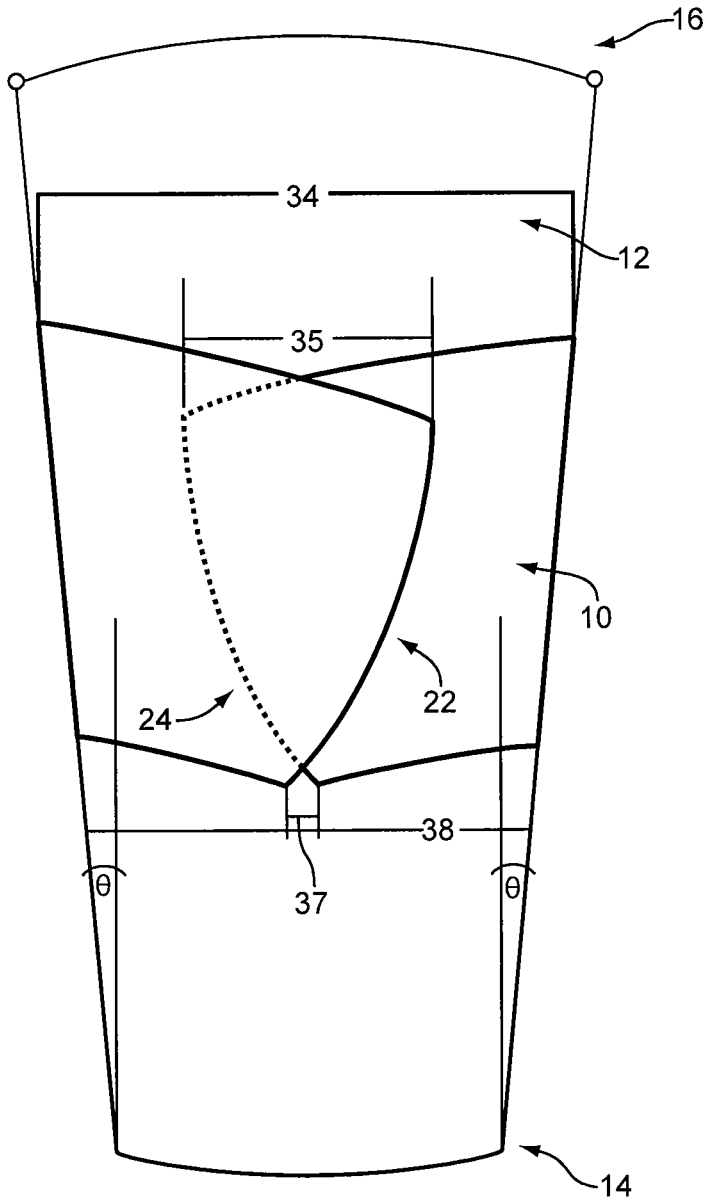
FIG. 6 is a view of a sleeve positioned with a container.

FIG. 6 illustrates a back view of the sleeve 10 positioned with the container 12. This view is merely illustrative as the appearance may be altered by the state of adjustment of the sleeve 10 and the taper angle Θ (FIG. 1) of the container 12. For example, the overlap distances 35, 37 may increase or decrease as a function of the taper angle Θ (FIG. 1). Further, the overlap distances 35 and 37 may adjust inversely, where as 35 increases 37 decreases and vice versa. The diameters 34, 38 may also increase or decrease as a function of the taper angle Θ (FIG. 1). Further, the diameters 34 and 38 may adjust inversely, for example, as diameter 34 increases diameter 38 decreases and vice versa.

Figure 8:
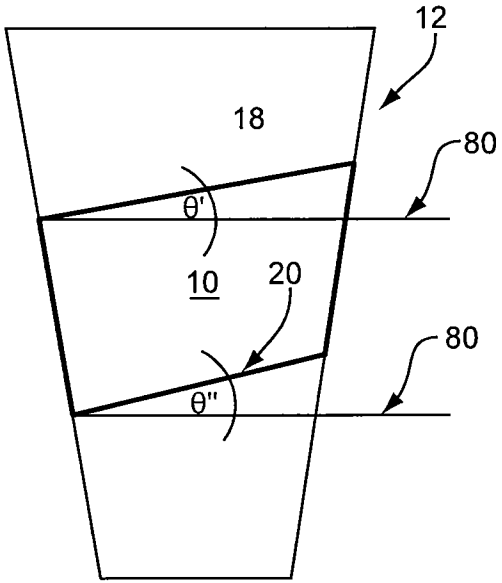
FIG. 8 is a second side view of a sleeve positioned with a container.
Figure 7:
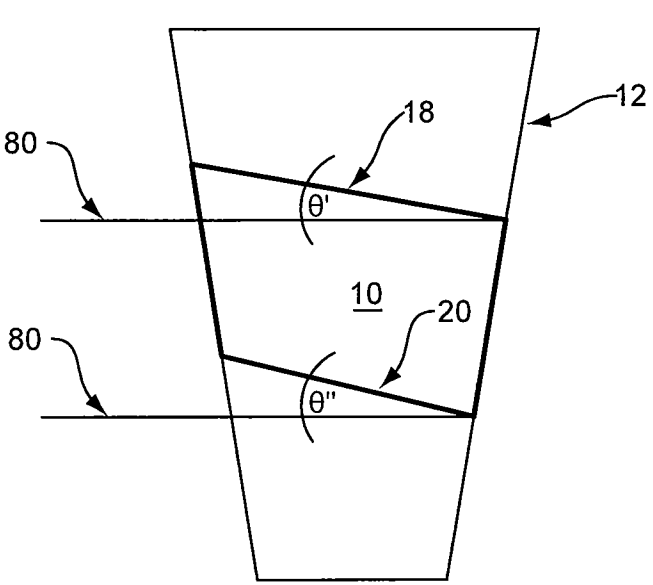
FIG. 7 is a first side view of a sleeve positioned with a container.
Figure 9:
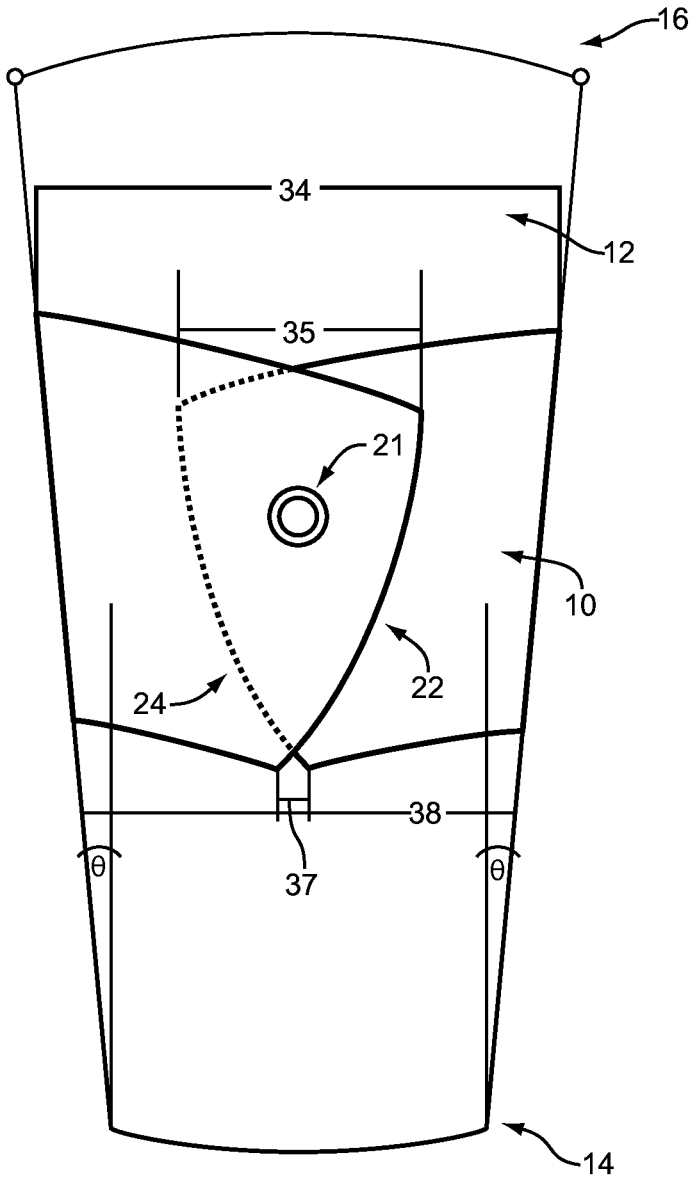
FIG. 9 is a view of a sleeve with a bolt applied to the pivot region.

FIGS. 7 and 8 illustrate a first side and second side view of the sleeve 10 positioned with the container 12. This view is merely illustrative as the appearance may be altered by the state of adjustment of the sleeve 10 and the taper angle Θ (FIGS. 1, 6) of the container 12. For example, the first edge 18 of the sleeve 10 may form an angle Θ' with respect to horizontal 80. Similarly, the second edge 20 of the sleeve 10 may form an angle Θ" with respect to horizontal 80. The angles Θ', Θ" may vary as a function of the state of adjustment of the sleeve 10 and the taper angle Θ (FIGS. 1, 6) of the container 12.

An adjustable sleeve for use with a container is disclosed. The taper of the sleeve may be adjustable such that the sleeve may fit a wide range of containers. The sleeve may also provide a thermal barrier between the container and a hand of a user. The width of the sleeve from top to bottom may approximate the width, for example, of at least two fingers of an adult human hand, and the shape may accommodate placing a thumb and at least three fingers on the sleeve.

Establishments may use the sleeve to apply information (e.g., information regarding contents as well as advertising, promotions, source information, branding, and instructions) to containers. The information may be time sensitive or have time limited relevance. Accordingly, establishments relying upon containers to convey information may be required to frequently revolve their disposable container stock. This may lead to waste (throwing away of "expired" container stock)

and/or delays. Reducing the amount of sheet material used in manufacturing protective sleeves by providing sleeves that are adjustable and usable with a range of containers may cause waste reduction, which may be better for the environment. The sleeve may be affixed to a container by inserting the container into the sleeve, or alternatively, wrapping the sleeve around the container and then affixing the ends of the sleeve together, and/or affixing the sleeve to the container.

While various embodiments of the invention have been described, it will be apparent to those of ordinary skill in the art that many more embodiments and implementations are possible that are within the scope of the invention.

We claim:

1. A sleeve for a container, comprising: a body having a first edge, a second edge, a first end and a second end; and the first end is secured to the second end by an adhesive located approximately centered between the first edge and the second edge to form the body into a configuration having an opening at the first edge and second edge; wherein the adhesive defines a pivot region that permits rotation of the first and second ends, once secured, the permitted rotation of the first end being in a direction opposite a direction of rotation of the second end to inversely change a size of the opening of the first edge and the opening of the second edge.

2. The sleeve of claim 1, wherein the adhesive is configured to provide the first end and second end to rotate.

3. The sleeve of claim 1, wherein the adhesive comprises a fugitive glue.

4. The sleeve of claim 1, wherein the adhesive is pressure sensitive.

5. The sleeve of claim 1, wherein the size of the opening of the first edge increases when the size of the opening at the second edge decreases.

6. The sleeve of claim 1, wherein the size of the opening of the first edge decreases when the size of the opening of the second edge increases.

7. The sleeve of claim 1, further comprising a surface barrier coating.

8. The sleeve of claim 1, further comprising a thermochromic feature.

9. The sleeve of claim 1, further comprising a photochromic feature.

10. A sleeve for a container, comprising: a body having a first edge, a second edge, a first end and a second end; and the first end is secured to the second end by an adhesive located approximately centered between the first edge and the second edge; wherein the adhesive defines a pivot region that permits rotation of the first and second ends, once secured, the permitted rotation of the first end being opposite in relation to the second end.

11. The sleeve of claim 10, wherein the adhesive comprises a fugitive glue.

12. The sleeve of claim 10, wherein the adhesive is pressure sensitive.

13. The sleeve of claim 10, wherein a size of an opening of the first edge increases and a size of an opening at the second edge decreases when the first end and the second end are pivoted.

14. The sleeve of claim 10, further comprising a surface barrier coating applied to the body.

15. The sleeve of claim 10, further comprising a thermochromic feature applied to the body.

16. The sleeve of claim 10, further comprising a photochromic feature applied to the body.

17. The sleeve of claim 10, further comprising perforations applied to the body.

* * * * *